US011052447B2

(12) United States Patent
Hejplik

(10) Patent No.: US 11,052,447 B2
(45) Date of Patent: Jul. 6, 2021

(54) RADIAL PRESS

(71) Applicant: UNIFLEX-HYDRAULIK GmbH, Karben (DE)

(72) Inventor: Vaclav Hejplik, Dietzenbach (DE)

(73) Assignee: UNIFLEX-HYDRAULIK GMBH, Karben (DE)

( * ) Notice: Subject to any disclaimer, the term of this patent is extended or adjusted under 35 U.S.C. 154(b) by 283 days.

(21) Appl. No.: 16/154,990

(22) Filed: Oct. 9, 2018

(65) Prior Publication Data

US 2019/0039113 A1 Feb. 7, 2019

Related U.S. Application Data

(63) Continuation of application No. PCT/EP2017/058731, filed on Apr. 12, 2017.

(30) Foreign Application Priority Data

Apr. 12, 2016 (DE) ..... 10 2016 106 650.8

(51) Int. Cl.
*B21D 39/04* (2006.01)
*B30B 1/40* (2006.01)
(Continued)

(52) U.S. Cl.
CPC ..... *B21D 39/048* (2013.01); *B25B 27/10* (2013.01); *B30B 1/40* (2013.01); *B30B 7/04* (2013.01)

(58) Field of Classification Search
CPC .... B21D 39/048; B21D 39/04; B21D 39/046; B21D 41/04; B21D 41/045; B30B 1/40; B30B 7/04; B25B 27/10
(Continued)

(56) References Cited

U.S. PATENT DOCUMENTS 2,427,685 A 9/1947 Midtlyng et al.
2,999,405 A * 9/1961 Ewart ..... B21C 37/30 72/402
(Continued)

FOREIGN PATENT DOCUMENTS

DE 2844475 A1 4/1980
DE 102011015706 A1 10/2012
(Continued)

OTHER PUBLICATIONS

Definition of several: Google, https://www.google.com/search?q=define+several&rlz=1C1GCEB_enUS785US786&oq=define+several&aqs=chrome.0.69i59j0l7.2649j0j1&sourceid=chrome&ie=UTF-8 (Year: 2020).*
(Continued)

*Primary Examiner* — Shelley M Self
*Assistant Examiner* — Jared O Brown
(74) *Attorney, Agent, or Firm* — Myers Wolin, LLC

(57) ABSTRACT

A radial press comprises a housing having a lateral portion and a supporting disk on the end face. A ring-like structure extends in the housing and can be displaced along a pressing axis. Multiple pressing jaws arranged around the axis are radially movably supported on the supporting disk. The ring-like structure acts upon the jaws with control faces angled relative to the axis and are seated against counter-faces of the jaws. The angle of the control faces changes as they progress in the axial direction, such that, along the maximum path of travel of the ring-like structure, the axial movement of said structure and the radial movement of the jaws produced thereby are at different ratios. The ring-like structure has exchangeable control elements on which control faces are provided. In planes perpendicular to the pressing axis, each control face is seated on a polygon having corners arranged between adjacent jaws.

28 Claims, 9 Drawing Sheets

(51) Int. Cl.
*B30B 7/04* (2006.01)
*B25B 27/10* (2006.01)

(58) Field of Classification Search
USPC ..... 72/399, 402; 269/309–310
See application file for complete search history.

(56) References Cited

U.S. PATENT DOCUMENTS

| | | | | |
|---|---|---|---|---|
| 4,107,964 | A * | 8/1978 | Smith | B21D 39/046 29/237 |
| 4,306,442 | A * | 12/1981 | Schrock | B21D 41/04 29/237 |
| 6,857,305 | B2 * | 2/2005 | Essen | B21J 9/06 72/402 |
| 2011/0023573 | A1 | 2/2011 | Intagliata et al. | |
| 2011/0185784 | A1 | 8/2011 | Van Essen et al. | |
| 2011/0185785 | A1 | 8/2011 | Goverdhana et al. | |

FOREIGN PATENT DOCUMENTS

| | | | | |
|---|---|---|---|---|
| EP | 0239875 | A2 | 10/1987 | |
| EP | 0539787 | A1 | 5/1993 | |
| EP | 1302255 | A1 * | 4/2003 | B21D 39/048 |
| EP | 1302255 | A1 | 4/2003 | |
| WO | 2005077566 | A1 | 8/2005 | |

OTHER PUBLICATIONS

International Search Report issued for corresponding International Application No. PCT/EP2017/058731 dated Aug. 30, 2017.

* cited by examiner

RADIAL PRESS

CROSS REFERENCE TO RELATED APPLICATIONS

This application is a continuation under 35 U.S.C. § 120 of International Application PCT/EP2017/058731, filed Apr. 12, 2017, which claims priority to German Application No. 10 2016 106 650.8, filed Apr. 12, 2016, the contents of each of which are incorporated by reference herein.

FIELD OF THE INVENTION

The present invention relates to a radial press having a housing provided with a jacket portion and an annular bracing disk on the end face, an annular structure guided displaceably therein along a press axis and several press jaws, which are disposed around the press axis, which are braced in radially displaceably guided manner on the bracing disk, and on which the annular structure acts by means of control faces, which are inclined relative to the press axis and which bear on mating faces of the press jaws constructed as sliding faces, wherein the angle of inclination of the control faces is changed along their travel in axial direction in such a way that their axial movement and the resulting radial movement of the press jaws are in different ratios relative to one another over the maximum movement path of the annular structure.

BACKGROUND

Radial presses of the class described in the foregoing are known from use in practice and also from the patent literature (e.g. DE 2844475 A1, WO 2005/077566 A1 and US 2011/0185785). Because the amplification ratio (or reduction ratio) of the axially directed movement of the annular structure changes into a radially directed movement of the press jaws over the displacement path of the annular structure, it is possible to realize radial presses that are able to press with relatively high force—over part of the pressing process—within a relatively short axial overall length. This is because, in a first phase of the pressing process (during the so-called "rapid mode")—corresponding to a relatively steep angle of attack of the control faces—the (radial) closing movement of the press jaws from the opened position of the die takes place at first over a relatively short displacement path of the annular structure, while in contrast, in a second phase of the pressing process (during the so-called "power mode")—corresponding to a relatively shallow angle of attack of the control faces—the closing movement of the press jaws then takes place over a relatively long displacement path of the annular structure. In this connection, the rapid mode is practical not only because more displacement path of the annular structure remains for power pressing; but also it contributes to the shortest possible cycle times and thus forms a viewpoint of the efficiency during use of the radial press.

Typically (see DE 2844475 A1, WO 2005/077566 A1 and FIG. 1-4 of US 2011/0185784 A1), the control faces—machined on the annular structure—are then situated on the surface of a cone, i.e. the control faces respectively form a frustoconical segment. In contrast to this, US 2011/0185784 A1 proposes that the control faces respectively comprise two plane sub-faces disposed at an angle relative to one another, wherein each press jaw is guided in the inside edge defined by the respective two associated sub-faces of the control face in question (FIG. 5-6 of US 2011/0185784 A1). According to EP 1302255 A1, edgeless, plane control faces (possibly respectively on the surface of sliding plates) are provided. An alternative configuration provides control faces of multi-stage construction.

SUMMARY

The present disclosure is directed toward providing a radial press of the class in question that is improved compared with the prior art presented in the foregoing. In particular, the radial press is intended to have compact dimensions and the smallest possible use of material and correspondingly weight, so that it can be manufactured very efficiently, reliably, durably and with relatively little expense.

This object is achieved according to the present disclosure by the fact that—in a radial press of the class explained in the introduction—the annular structure has a base structure and, received therein, exchangeable control members with control faces constructed thereon, wherein, in planes perpendicular to the press axis, the control faces respectively lie on a polygon with corners disposed respectively between two press jaws adjacent to one another.

A special advantage of this construction consists in the easy and problem-free adaptability of the characteristic of the closing movement of the press jaws to their respective pressing task. This is so because the exchange of the control members (possibly along with simultaneous exchange of the press jaws), due to the three-dimensional geometry of which the characteristic of the relationship between the axial movement of the annular structure and the radial movement of the press jaws, i.e. the changing ratio of the two movements relative to one another over the displacement path of the annular structure, is defined, makes it possible, for example, to influence not only the distribution of the total closing of the press jaws between rapid mode and pressing mode but also (via the angle of inclination of the control faces) the maximum pressing force. In addition, the construction of the annular structure such that it has a base structure, and received therein, exchangeable control members, which respectively bear on the base structure along a bracing face and have control faces constructed thereon, has advantages from the fabrication viewpoint.

Due to the construction of the control faces such that, in planes perpendicular to the press axis, the control faces respectively lie on a polygon with corners respectively disposed between two press jaws adjacent to one another, it is additionally possible to achieve an optimum transfer, significantly superior to that of the prior art according to US 2011/0185784 A1, of the reaction forces acting on the press jaws during the pressing of a workpiece via the annular structure into the housing of the radial press. In particular, it is not only the problem, explained in US 2011/0185784 A1 with regard to frustoconically shaped control faces, of merely linear bracing of the press jaws that is avoided. Moreover, in contrast to the concept according to US 2011/0185784 A1, the center of load transfer or the transfer of the main load from the press jaws into the annular structure takes place not in a region in which the annular structure is weakened by the sub-faces of the control faces running together at edges (because of the notch effect) but instead in a region of maximum strength of the annular structure. Accordingly, by implementation of the embodiment described, it is possible to work with an annular structure that can be constructed substantially more weakly than according to the prior art, which is favorable both for the (compact) overall dimensions as well as for the (low) weight of the radial press. Since, by implementation of the embodiment described, the transfer of the main load takes place not in the region of an edge, where, for fabrication-related reasons (puncture on the annular structure and/or radius on the press jaws!), continuously steady contact of the sliding faces of the press jaws on the control faces of the annular structure can be achieved not over the entire width—considered in circumferential direction—of the press jaws in the respective plane perpendicular to the press axis, but instead over a region situated respectively between two edges, the sliding faces of the press jaws on the control faces of the annular structure are respectively able to bear on one another, steadily along a straight line of contact, over the entire width of the press jaws in the respective plane perpendicular to the press axis. This avoids point pressure or stress peaks, thus favoring sliding behavior of the press jaws on the annular structure. In addition, this makes it possible—according to a preferred improvement—that, at least during individual operating positions of the annular structure, the control faces thereof and the sliding faces of the press jaws bear with full surface on one another over their entire width in the region of plane faces.

The control members provided preferably bear (especially from fabrication-related viewpoints) respectively along a plane bracing face on the base structure of the annular structure, wherein those plane bracing faces may extend at an inclination or else parallel to the press axis, wherein, in the latter case, the control members are in principle constructed to be more or less wedge-shaped. According to another preferred improvement, however, the control members bear with full surface on a convex bracing face of the base structure. Here also the bracing faces may again converge in axial direction, for example by being constructed on the surface of a truncated cone, or else they do not converge, for example due to construction of the bracing faces on the surface of a cylinder.

For guidance of the press jaws, it is particularly preferable to provide, on the annular structure, press-jaw guide ribs, which laterally frame or bound the control faces (at least locally). For this purpose, press-jaw guide ribs constructed between two control members respectively on the base structure may be provided, so that the control members are respectively inserted between two press-jaw guide ribs, which project radially inward (at least locally) beyond the control members, i.e. beyond the control faces constructed on these, in order to guide the press jaws. In an alternative construction, the control members themselves may be provided with lateral press-jaw guide ribs projecting beyond the control faces.

The present disclosure can be implemented particularly advantageously in such radial presses in which the control faces respectively have at least two separate plane regions (with different angles of inclination relative to the press axis), so that two (or possibly more) defined amplification ratios of the movements of the annular structure and of the press jaws are obtained over the entire range of movement of the annular structure. For the purpose of double bracing of the press jaws in two planes (or regions) offset axially relative to one another in such a way that the hazard of tilting of the press jaws in the case of eccentric arrangement of the workpiece is definitively reduced, the control faces may then be provided in particular with four plane regions offset parallel to one another in pairs. Plane regions adjacent to one another may then be in particular edgeless, i.e. may merge into one another via transition radii connected to one another.

Within the scope of the present disclosure, however, the alternative construction of the control faces also comes into consideration in particular in such a way that the angle of inclination of the control faces changes continuously over a considerable fraction of their extent. In this improvement, the amplification ratio of the movements of the annular structure and of the press jaws relative to one another accordingly changes continuously over the corresponding movement range of the annular structure. In this improvement, however, the region in which the inclination of the respective control face changes continuously respectively merges particularly preferably into a plane region of the control face. In this way, full-surface bracing of the press jaws on the annular structure can be achieved toward the end of the pressing process, i.e. in the phase of maximum demand for pressing power. This is advantageous with respect both to the sliding behavior and the surface pressures, wherein small surface pressures in turn act favorably on the necessary dimensions of the structural parts.

Yet another preferred improvement of the disclosure, which is advantageous in particular from the manufacturing viewpoint, is characterized in that the control members respectively have a bed plate bearing on the base structure and a hump placed on a portion thereof. This is true in any case for the embodiment already explained hereinabove, in which the control faces have four plane regions offset parallel to one another in pairs. But in any case, it is not only in this improvement also that incidentally it is further particularly advantageous when the control faces are constructed on the surface of exchangeable sliding plates. These sliding plates may consist of a material matched ideally to their specific function. And, in the case of advanced wear or damage (due to a foreign body), the individual sliding plates may be renovated with only minimum expense. The use of separate sliding plates then again benefits from the face that, according to the disclosure, the control faces in planes perpendicular to the press axis respectively lie on a polygon with corners disposed respectively between two press jaws adjacent to one another. This is so because, as a consequence, the sliding plates can be manufactured from conventional sheet-metal material by bending solely in one dimension. If—according to a preferred improvement—each control member is assembled with two sliding plates, which define four control faces offset parallel to one another in pairs, the two sliding plates are preferably identical to one another. This is favorable from viewpoints of fabrication and storage costs, and it reduces the hazard of faulty assembly of the control members.

As an alternative to separate control-member sliding plates, the press jaws may be provided comparatively advantageously with exchangeable sliding plates, on which the sliding faces are constructed.

According to yet another preferred improvement of the disclosure, the annular structure comprises an annular piston, which is guided sealingly in a press-cylinder portion constructed in the jacket portion of the housing and together therewith bounds an annular press working chamber. At its end opposite the annular piston, the press working chamber can be bound by a housing closure ring, which is disposed opposite the bracing disk and in which a sleeve-like extension of the annular structure—bounding the press working chamber radially inwardly—is guided sealingly, especially when—according to a preferred improvement—the bracing disk and the jacket portion are part of a one-piece basic structure of the housing. In the interests of a completely-hydraulic drive for the movement of the annular structure, an annular return-stroke working chamber is particularly preferably disposed between the press working chamber and the bracing disk. Particularly advantageously, this may be bounded by a cylindrical face disposed on the outer circumference of the annular structure and guided in a sealing shoulder integral with the housing. By the fact that the annular structure in this improvement is braced, at its end adjacent to the bracing disk, on the housing not in a manner guided therein, but instead—depending on the position of the annular structure in the housing—in a manner more or less distant therefrom, it is particularly favorable when the annular structure is surrounded at its end region turned toward the bracing disk by a nonmetallic fiber reinforcing ring. For only minimum dimensions of the annular structure, this ensures its dimensional stability even under high radial loads, i.e. high pressing forces toward the end of the pressing process, when the end of the annular structure exposed to the radial reaction forces of the press jaws protrudes particularly far beyond the sealing shoulder integral with the housing.

An annular wiper, which cleans the outer circumference of the annular structure, in order to protect the seal received in the sealing shoulder, may be provided on this sealing shoulder. In this construction of the return-stroke working chamber, the jacket portion of the housing may be provided between the sealing shoulder and the bracing disk, particularly preferably directly adjacent to the sealing shoulder, with a dirt outlet opening (preferably relatively generously dimensioned and disposed at the lowest point of the annular space in question).

Particularly advantageously, the return-stroke working chamber is then bounded by the press-cylinder portion and an annular zone constructed on the annular piston at its end face turned away from the press working chamber. Thus only one single through-going cylinder face to be constructed on the housing is needed for both hydraulic working chambers, thus favoring simple and cost-effective fabrication of the radial press.

Yet another preferred improvement of the disclosure is characterized in that exchangeable guide elements cooperating with the press jaws and effecting their sliding guidance in radial direction are attached to the bracing disk. By virtue of the exchangeability, it is ensured that high-quality fabrication of the radial press can be maintained over the long term. The corresponding renovation of the sliding elements is then associated with particularly low maintenance expense when the housing is provided at the transition from the jacket portion to the bracing disk with a number of cutouts, corresponding to the number of press jaws, through which the guide elements can be inserted into the housing. In particular, these guide elements may be angled and be provided respectively with a fixation bracket bearing radially on the outside of a bracing face, wherein the guide elements may be bolted together with the housing in the region of the cutouts from radially outside (especially in the region of each fixation bracket).

By analogy with the implementation of the present disclosure on a so-called "hollow piston press", as explained comprehensively and in detail in the foregoing, the disclosure can also be realized—with identical advantages—on radial presses of the so-called "pressure-plate design". In this sense, the subject matter of the disclosure in an alternative configuration is a radial press having a bracing plate disposed at the end face and extending annularly around a cutout, an annular structure guided displaceably relative thereto along a press axis, a drive unit acting between the bracing plate and the annular structure and several press jaws, which are disposed around the press axis, which are braced in displaceably guided manner with radial directional components on the bracing disk, and on which the annular structure acts by means of control faces, which are inclined relative to the press axis and which bear on mating faces of the press jaws constructed as sliding faces, wherein the angle of inclination of the control faces is changed along their travel in axial direction in such a way that, over the maximum movement path of the annular structure and of the bracing plate relative to one another, the axial movement in question and the resulting radial movement of the press jaws are in different ratios relative to one another, wherein the annular structure has a base structure and exchangeable control members received therein with control faces constructed thereon, wherein, in planes perpendicular to the press axis, the control faces respectively bear on a polygon with corners disposed respectively between two press jaws adjacent to one another. The special configuration features described in the foregoing in connection with hollow-piston presses, especially inasmuch as they are explained as preferred improvements, can also be implemented correspondingly in radial presses of the pressure-plate design. Since this is immediately obvious to a person skilled in the art from the foregoing explanations, however, a detailed description in this respect will not be provided, in order to avoid repetitions.

BRIEF DESCRIPTION OF THE DRAWING

The present invention will be explained in more detail hereinafter on the basis of various preferred exemplary embodiments illustrated in the drawing, wherein.

DETAILED DESCRIPTION OF THE PREFERRED EMBODIMENTS

Figure 1:
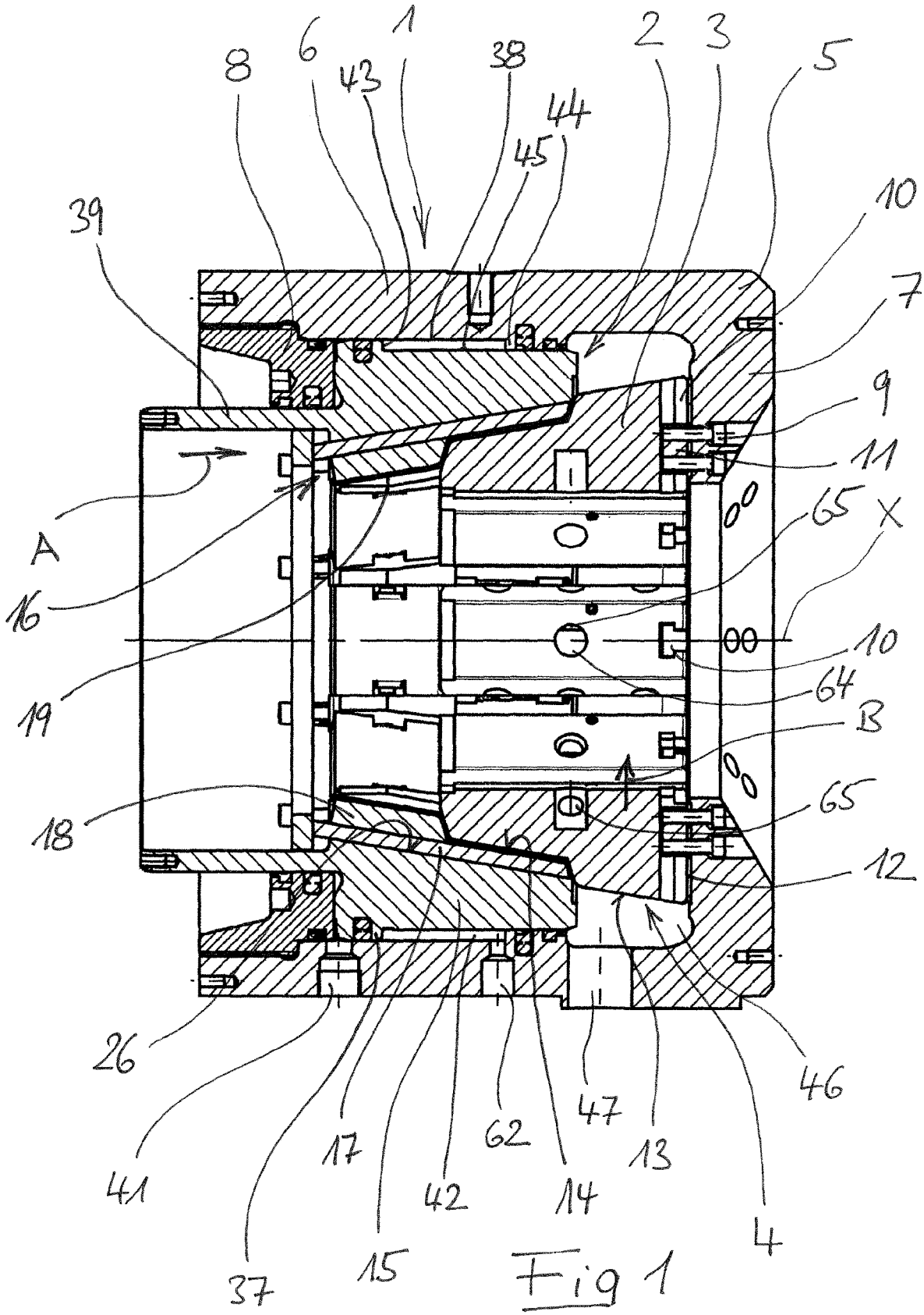
FIG. 1 shows an axial section through a first exemplary embodiment of a radial press constructed with opened die.
Figure 2:
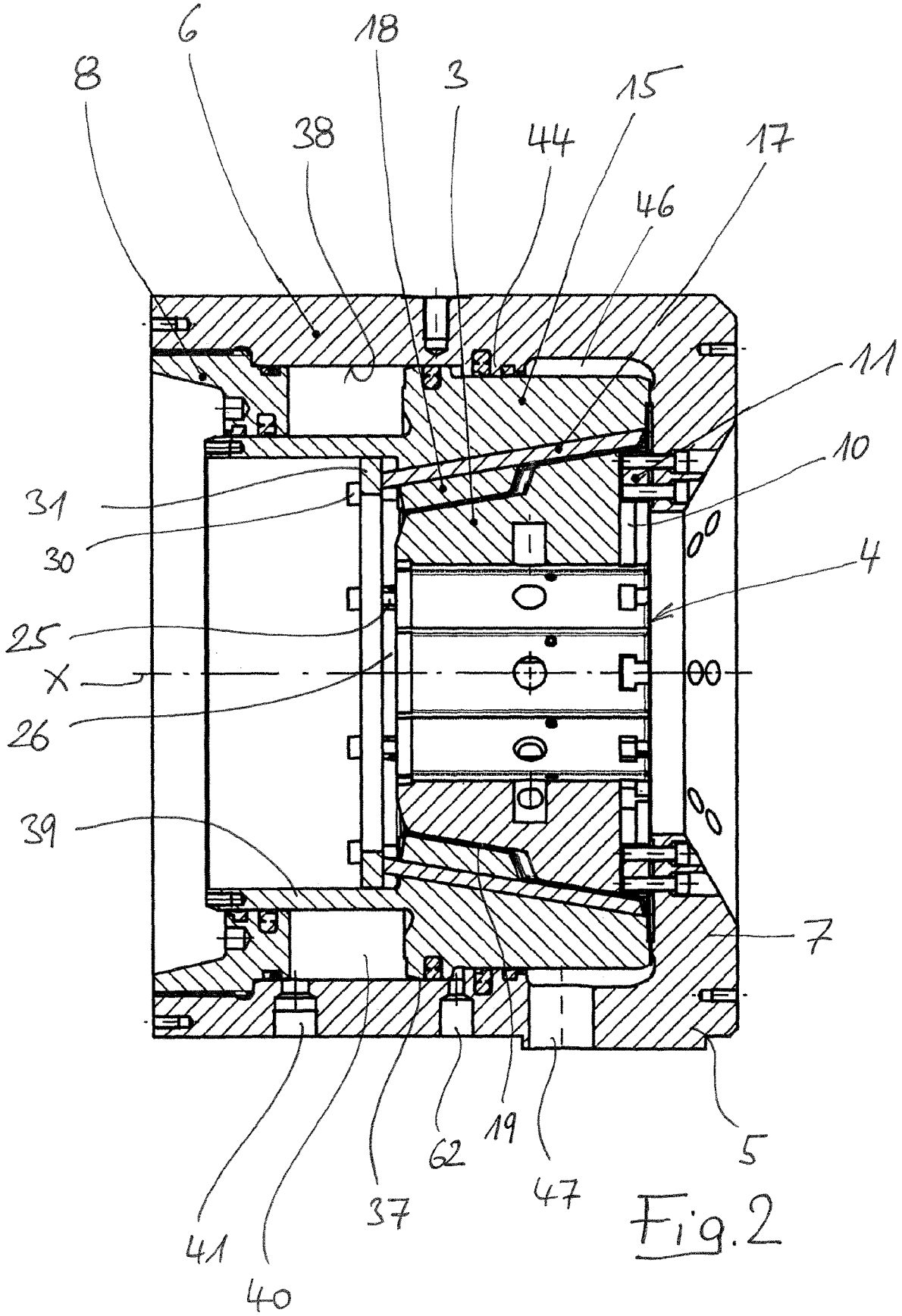
FIG. 2 shows an axial section of the radial press according to FIG. 1 with closed die.
Figure 3:
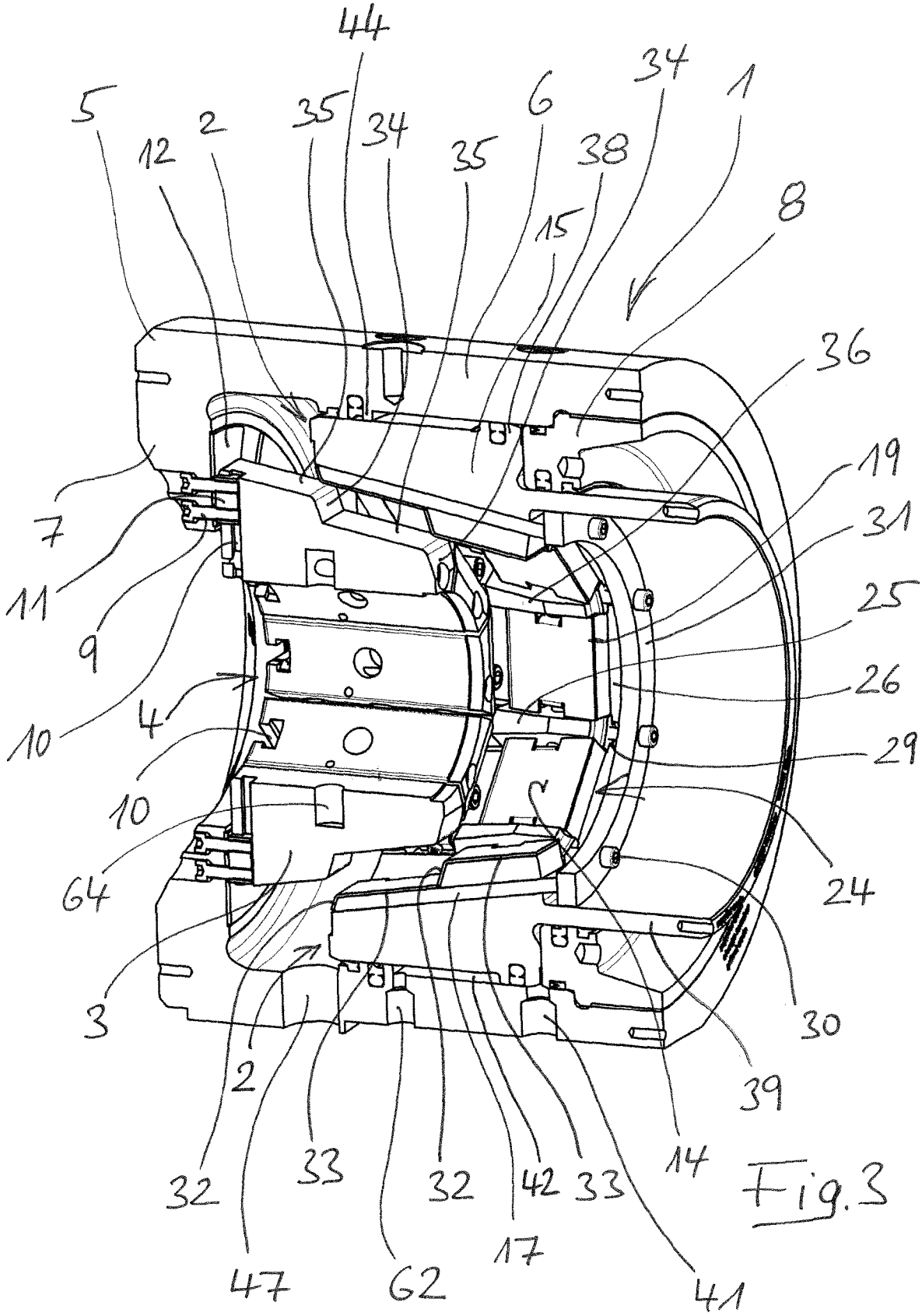
FIG. 3 shows a cutaway perspective view of the radial press according to FIGS. 1 and 2 in its maintenance position.
Figure 4:
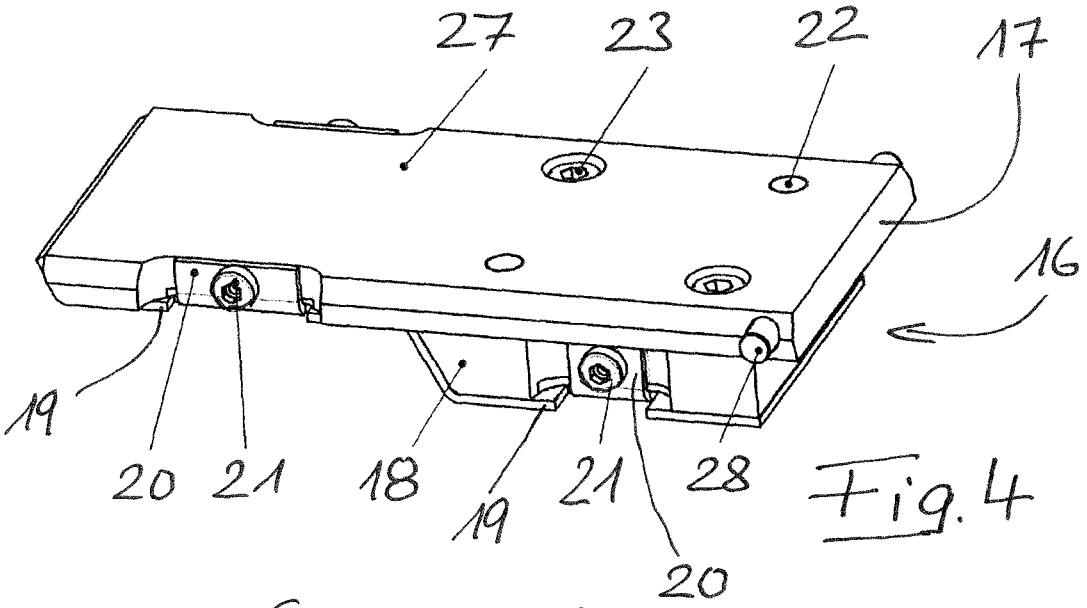
FIG. 4 shows a perspective view of the back side of the control members used in the radial press according to FIGS. 1 to 3.

The hydraulic radial press according to a first exemplary embodiment shown in FIGS. 1 to 4 of the drawing comprises, as main components, a substantially rotationally symmetric housing 1, an annular structure 2 guided displaceably therein along axis X and a press die 4 provided with eight press jaws 3 disposed around press axis X. Housing 1 comprises a one-piece housing basic structure 5 with a jacket portion 6 and an annular bracing disk 7 on the end face, as well as a housing closure ring 8 disposed opposite bracing disk 7 in the jacket structure and fixed there. Press jaws 3 are braced—in a manner guided radially displaceably via guide elements 11 (sliding blocks), which are attached exchangeably by means of bolts 9 (preferably two respectively) to bracing disk 7 and which cooperate with guideways 10 provided on press jaws 3—on bracing disk 7, wherein respectively one friction-reducing bearing plate 12 is disposed between the end faces of press jaws 3 and bracing disk 7. Radially outside, press jaws 3 have sliding faces 13. These form mating faces to control faces 14, which are provided on annular structure 2 and inclined relative to press axis X and which cooperate with sliding faces 13 in such a way that an axial displacement (arrow A) of annular structure 2 relative to bracing disk 7 causes a radially inwardly directed movement (arrow B) of press jaws 3. Over the total possible movement path of annular structure 2, the ratio of the axial movement of annular structure 2 to the radial movement of press jaws 3 then changes by the fact that the angle of inclination of control faces 14 varies along their travel in axial direction.

Within the scope described in the foregoing, the radial press according to FIGS. 1 to 4 corresponds to the sufficiently well known prior art disclosed in the documents cited in the introduction, to which reference is made, and so more extensive explanations are not needed.

Annular structure 2 has an annularly closed base structure 15 and eight exchangeable control members 16, on which control faces 14 are constructed, received therein. These control members in turn are multi-part components, by the fact that they are respectively provided with a bed plate 17 (substantially plane in the present case) and a hump 18 placed on a portion thereof as well as two sliding plates 19, which are placed exchangeably on bed plate 17 or hump 18 and on which control faces 14 are constructed. Sliding plates 19 (which may be angled) are respectively fastened to bed plate 17 or to hump 18 via laterally disposed, angled fixation brackets 20 and bolts 21. Humps 18 are respectively fixed on the associated bed plate 17 via centering pins 22 and bolts 23.

To receive the eight control members 16, eight pockets 24, which are defined by respectively two ribs 25 and a bracing face 26 disposed between these, are constructed on the inside of base structure 15. Bed plates 17 of control members 16 then rest on base structure 15 on plane bracing faces 26; accordingly, they have plane rear faces 27. For their assembly, control members 16 are pushed axially into the associated pockets 24, wherein pegs 28 protruding from bed plate 17 are inserted into associated recesses 29 provided in ribs 25. By means of a locking ring 31, which is fixed on base structure 15 of annular structure 2 by bolts 30, which are screwed at their end face into ribs 25, the eight control members 16 are then secured in their assembled position.

According to the foregoing descriptions, it is therefore, control members 16—received exchangeably in base structure 15—which, by their specific geometry determining the travel of control faces 14, define that individual characteristic relationship between the axial movement of annular structure 2 and the radial movement of press jaws 3 induced hereby which is determining for the operating characteristic of the respective radial press in its specific assembly with control members 16.

Expedient modifications of the construction described in the foregoing may consist in the fact that, for fixation of control members 16, a segmented locking ring 31 or individual locking plates are used, wherein the locking-ring segments or locking plates in question are in turn preferably fixed at their end face on ribs 25 by means of bolts (e.g. respectively disposed in the joint between two locking plates). Pegs 28 on control members 16 may be omitted, for example by the fact that control members 16 are fixed (e.g. by means of two bolts) on the end face of locking ring 31 or the locking-ring segments or locking plates. And instead of bracing faces 26 converging in axial direction, annular structure 15 could be provided—for simplified manufacturer thereof—with, for example, (plane or convex) bracing faces extending parallel to press axis X, wherein in this case control members 16 would have a basic form that in principle is wedge-shaped.

Control faces 14 of each control member 16 have four plane regions, which are respectively offset parallel to one another in pairs, namely two rapid-mode regions 32 with a large angle of inclination relative to axis X and two power-mode regions 33 with a small angle of inclination relative to axis X. In this way, control faces 14 in planes perpendicular to press axis X respectively lie on a polygon with corners disposed respectively between two press jaws 3 adjacent to one another. By the fact that each of the two sliding plates 19 of each control member 16 is singly angled, an edgeless transition (with small radius) is formed from the respective rapid-mode region 32 of control face 14 to the associated power-mode region 33. In an improvement preferred compared with the illustrated configuration, the two sliding plates 19 are respectively identical to one another.

Sliding faces 13 of press jaws 3 likewise have four plane regions, which are respectively offset parallel to one another in pairs, namely two rapid-mode regions 34 with a large angle of inclination relative to axis X and two power-mode regions 35 with a small angle of inclination relative to axis X. Hereby, during the pressing process, each of the eight press jaws 3 bears constantly with full surface—except for the transition from rapid mode to power mode—of their sliding faces 13, and specifically in the region of two faces disposed axially apart from one another, on corresponding control faces 14 of annular structure 2, wherein the size of the contact faces increases steadily during the power mode. Ribs 25 already mentioned hereinabove protrude radially inwardly beyond control faces 14, such that they also ensure—as press-jaw guide ribs 36—the guidance of press jaws 3 in axial direction.

A double-acting hydraulic drive is used to move annular structure 2. For this purpose, annular structure 2 comprises an annular piston 37, which is guided sealingly in a cylinder portion 38 constructed in jacket portion 6 of housing 1. Cylinder portion 38, annular piston 37, housing closure ring 8 and a sleeve-like extension 39 of annular structure 2 guided sealingly therein together bound an annular press working chamber 40. This can be pressurized via press port 41. An annular return-stroke working chamber 42 is disposed between press working chamber 40 and bracing disk 7. This is bounded by cylinder portion 38—which also bounds press working chamber 40—and by an annular zone 43 constructed on annular piston 37 on its end face turned away from press working chamber 40, a sealing shoulder 44 integral with the housing and a cylinder face 45 guided therein and disposed on the outer circumference of base structure 15 of annular structure 2. Return-stroke working chamber 42 can be pressurized via return-stroke port 62.

Jacket portion 6 of housing 1 is provided between bracing disk 7 and sealing shoulder 44, and specifically in a manner directly adjacent to the latter, with a dirt outlet opening 47 at the lowest point of annular space 46 in question. According to the present exemplary embodiment, its diameter or opening width is preferably larger than the maximum spacing between two press jaws 3 adjacent to one another in the maximally opened position of the die. Thus dirt that has penetrated into annular space 46 is able to exit this reliably once again via dirt outlet opening 47.

Figure 5:
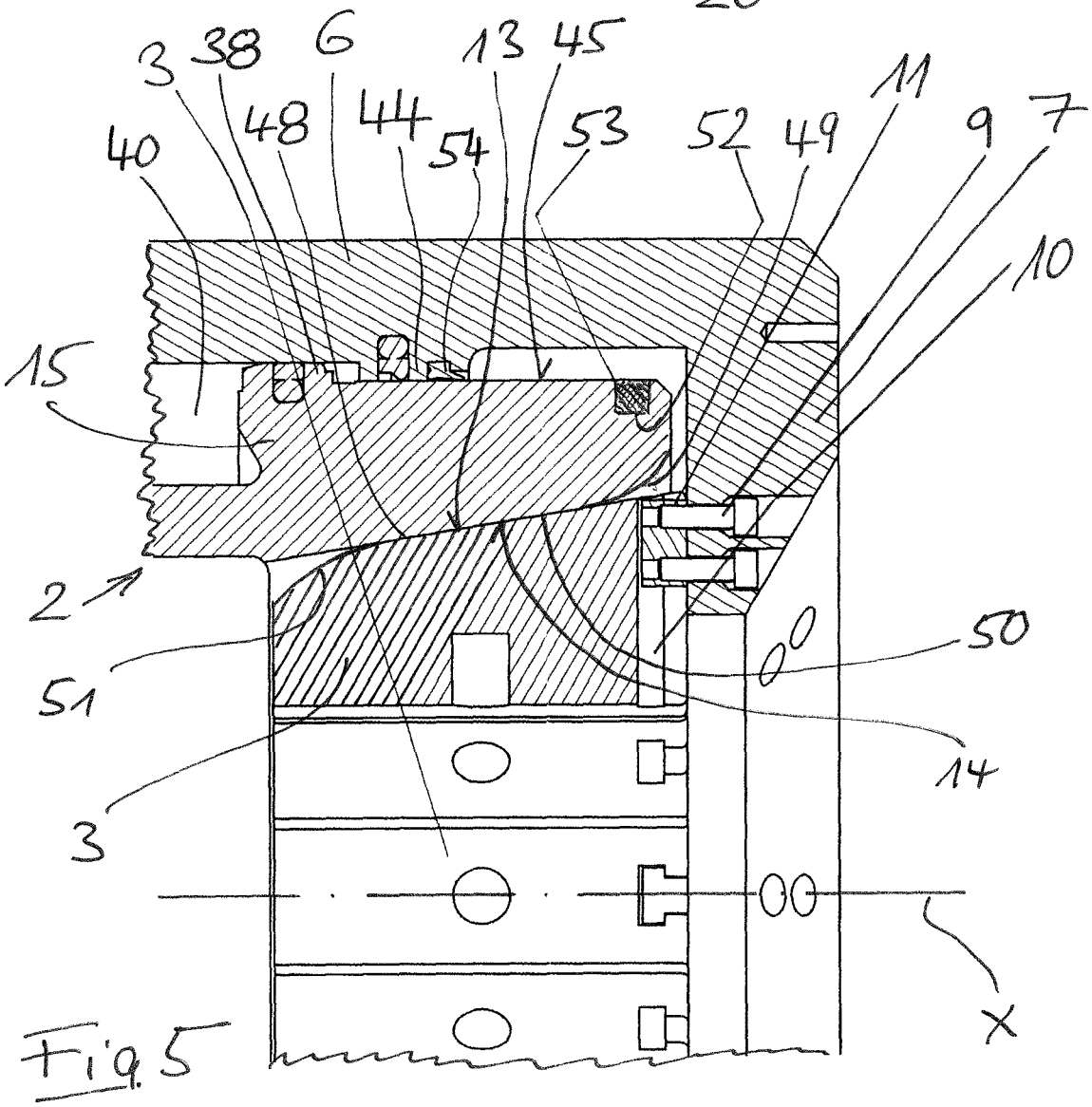
FIG. 5 shows a cutout from an axial section through a radial press constructed according to a first comparison example with closed die.

FIG. 5 illustrates—within the scope relevant here—an embodiment modified compared with the radial press according to FIGS. 1 to 4. In view of the foregoing explanations of FIGS. 1 to 4, to which reference is made, this is largely self-explanatory. In particular, two technical features must be pointed out: On the one hand, the control faces, in contrast to FIGS. 1 to 4, have not four plane regions but instead only one plane region 48. A region 49, which extends over a considerable fraction of the axial extent of control face 14, and in which the angle of inclination of control face 14 relative to axis X changes continuously, merges edgelessly therein. Corresponding to this, sliding faces 13 of press jaws 3 are configured such that they respectively have precisely one plane region 50 and, merging edgelessly into it, a region 51, which extends over a considerable fraction of the axial extent of sliding face 13, and in which the angle of inclination of sliding face 13 relative to axis X changes continuously.

This geometry is then illustrated on the basis of a construction in which—in contrast to the present disclosure—control faces 14 are constructed directly on base structure 15 of annular structure 2. Obviously, however, the same can also be realized with separate, exchangeable control members by the principle, characteristic for the present disclosure, shown in FIGS. 1 to 4. This control-face geometry is likewise realizable not only in such radial presses which need lubrication, such as that according to FIG. 5, but also in lubrication-free radial presses provided with separate sliding plates.

Furthermore, it is illustrated in FIG. 5 that a nonmetallic fiber reinforcing ring 53 is worked into annular structure 2, namely into a corresponding annular groove 52 of base structure 15 on its end region turned toward bracing disk 7. This extends in closed manner around axis X in a plane perpendicular to axis X and on the outside is connected flush with cylinder face 45, so that wiper 54 inserted in sealing shoulder 44 cleans dirt from the outer face of fiber reinforcing ring 53 just as well as from cylinder face 45.

Figure 6:
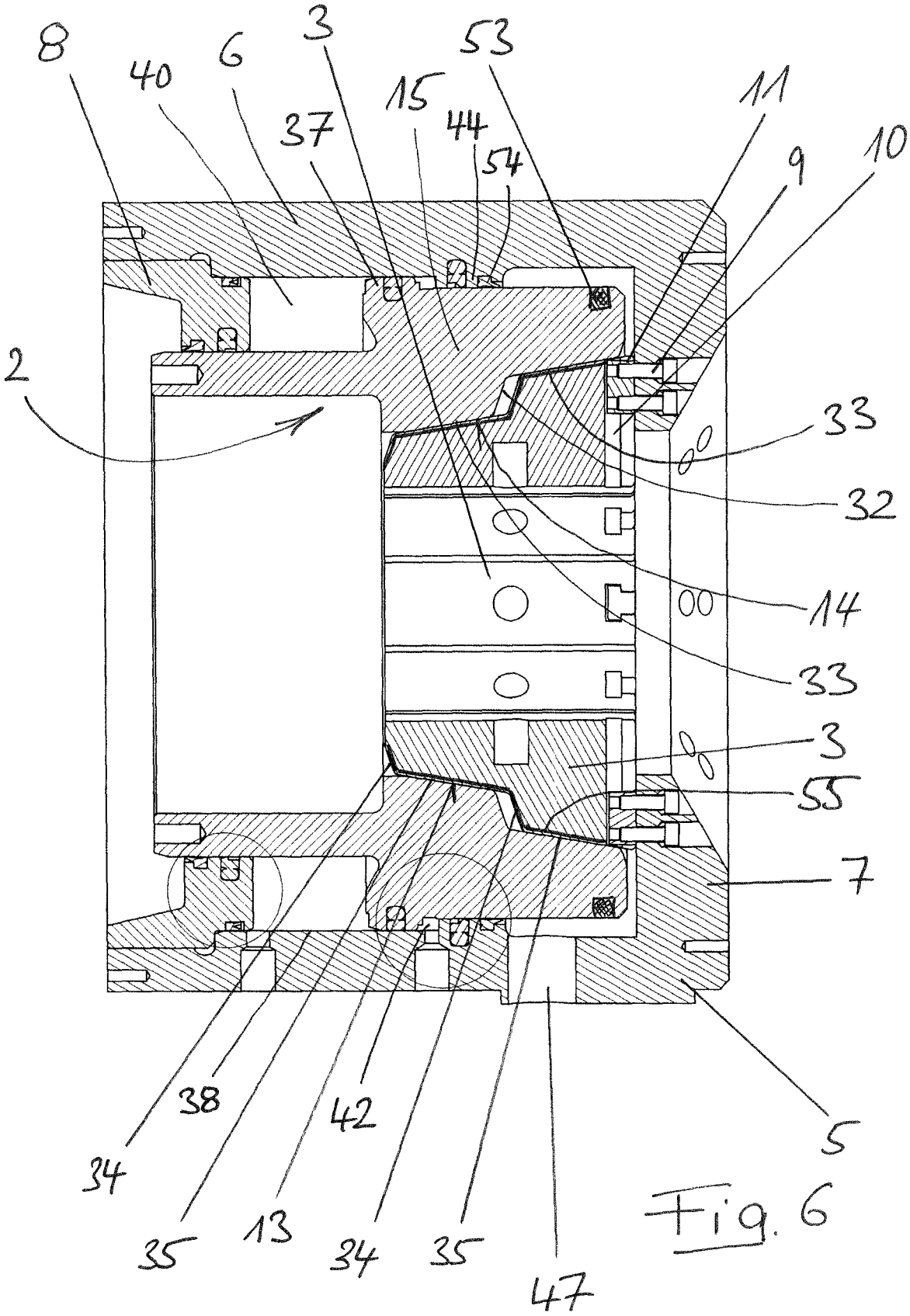
FIG. 6 shows an axial section through a radial press constructed according to a second comparison example with closed die.

FIG. 6 illustrates yet another modified (lubrication-free) radial press, which differs from that according to FIGS. 1 to 4 substantially by the fact that sliding plates 55 are associated here not with annular structure 2 but instead with press jaws 3, so that sliding faces 13 are constructed on sliding plates 55. As regards the shown specified geometry of control faces 14 and of sliding faces 13, the foregoing description of FIG. 5 is applicable, i.e. the illustrated principle of sliding plates 55 on the press-jaw side could obviously also be implemented with geometries of control faces 14 and of sliding faces 13 different from those according to FIG. 5. And once again it is obvious that control faces 14, instead of being constructed directly on base structure 15 of annular structure 2, can be constructed in a manner corresponding to the present disclosure on separate, exchangeable control members.

As regards fiber reinforcing ring 53, which is also provided here, the foregoing explanations of FIG. 5 apply correspondingly.

Figure 7:
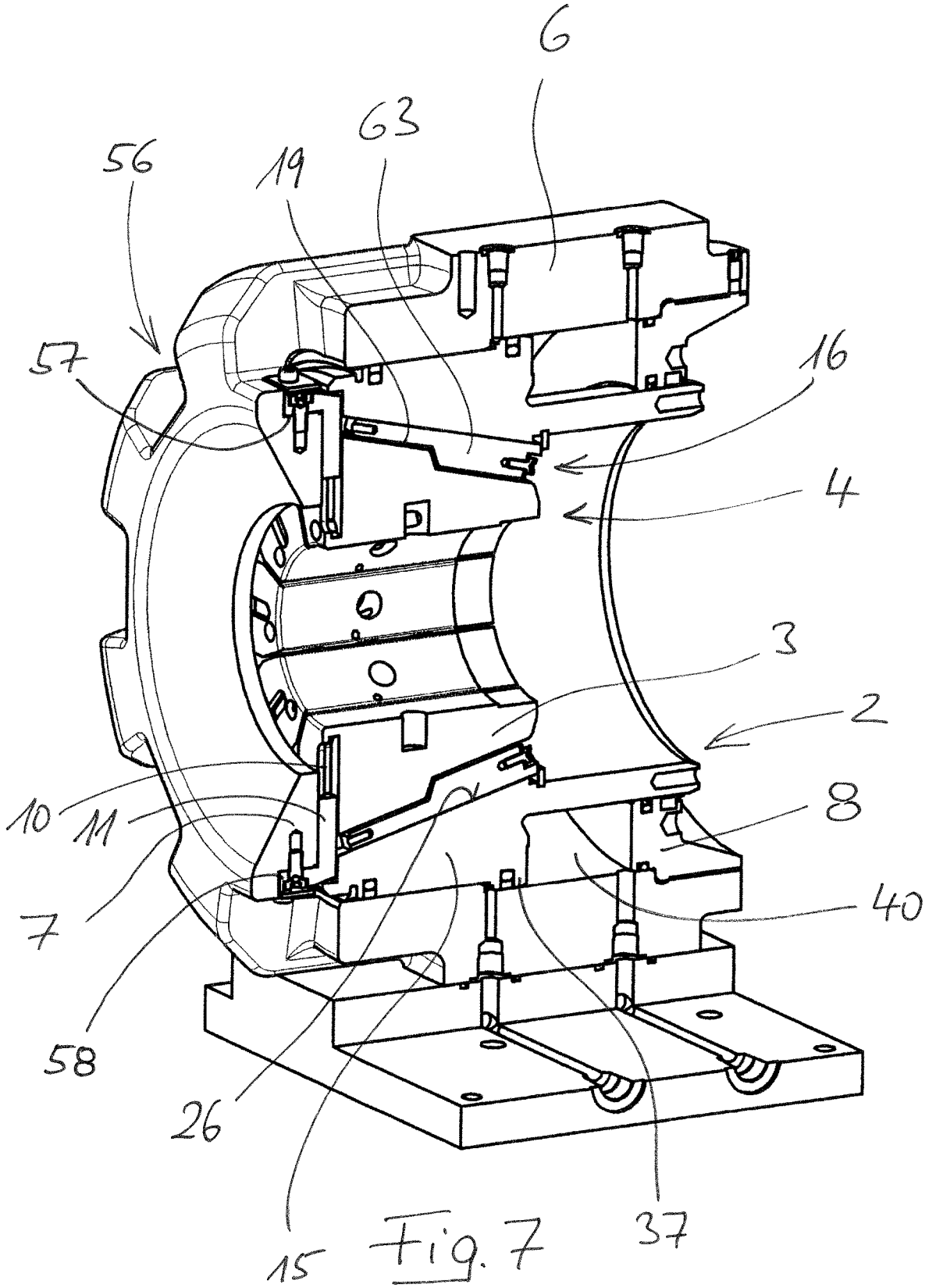
FIG. 7 shows a cutaway perspective view of a radial press constructed according to a second exemplary embodiment with closed die and FIG. 8 shows an axial section through the radial press according to FIG. 7 in an operating condition during power pressing. Furthermore.
Figure 8:
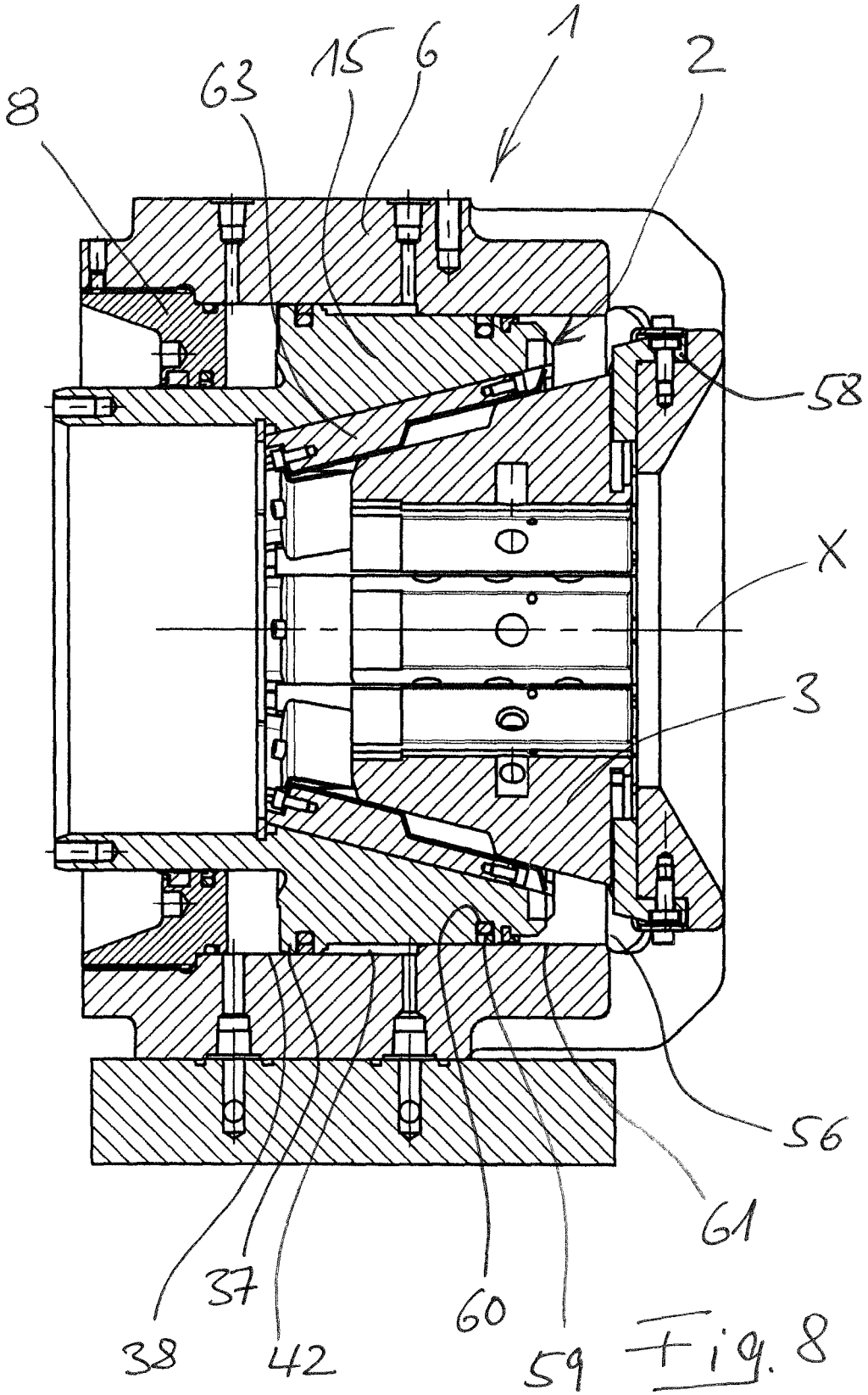
Figure 9:
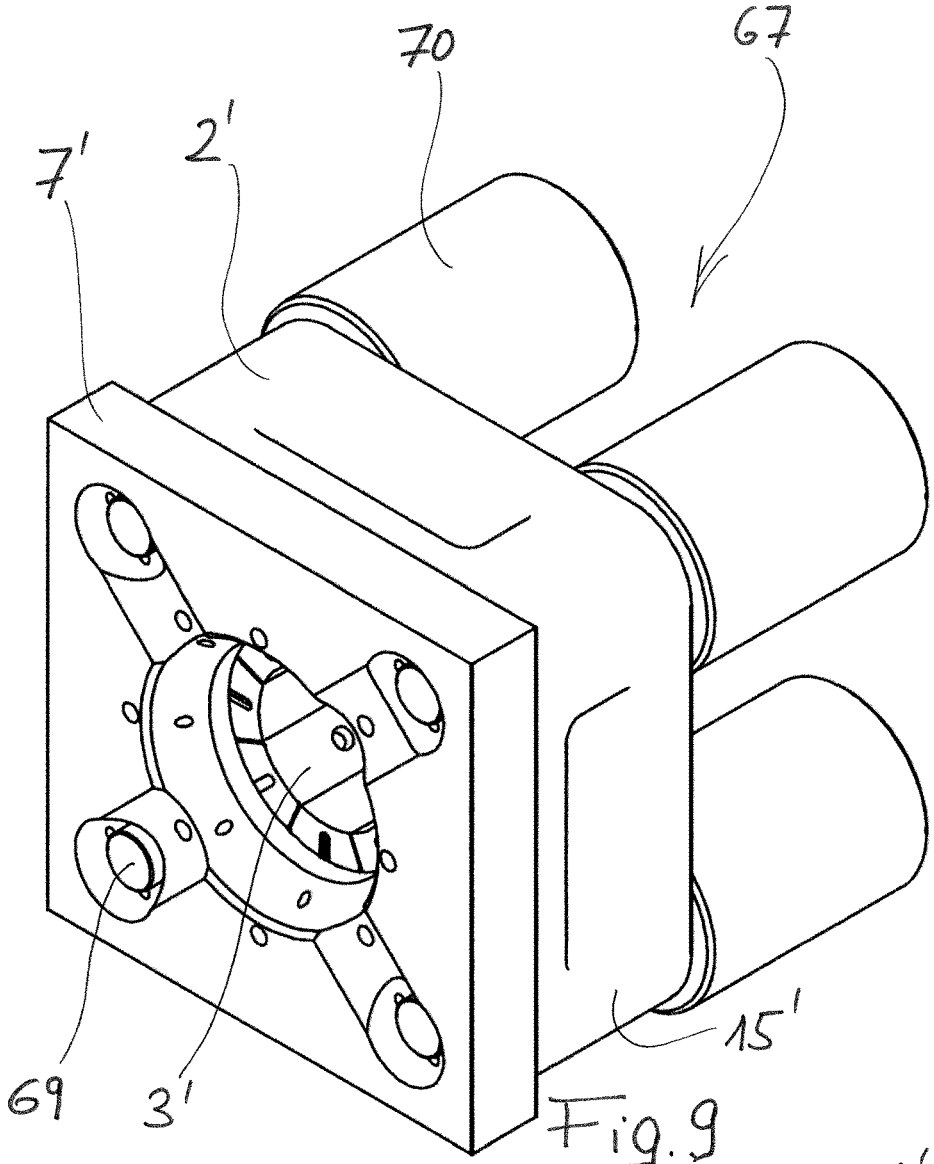
FIG. 9 shows a perspective view of a radial press constructed in pressure-plate design.
Figure 12:
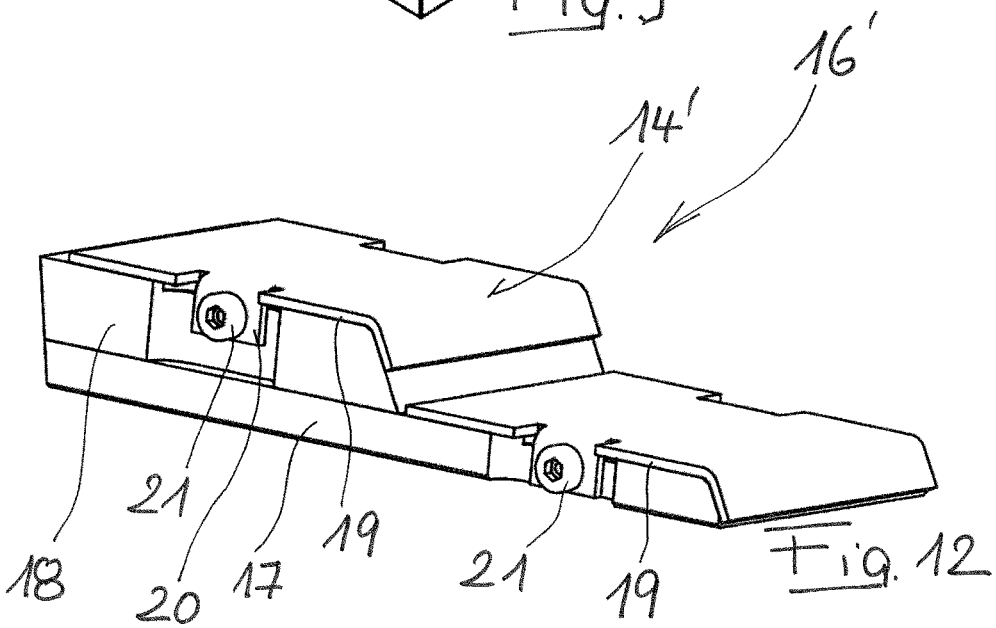
FIG. 11 shows the radial press according to FIG. 10 in closed operating position and FIG. 12 shows a detail view of the control members used in the radial press according to FIGS. 10 and 11.
Figure 10:
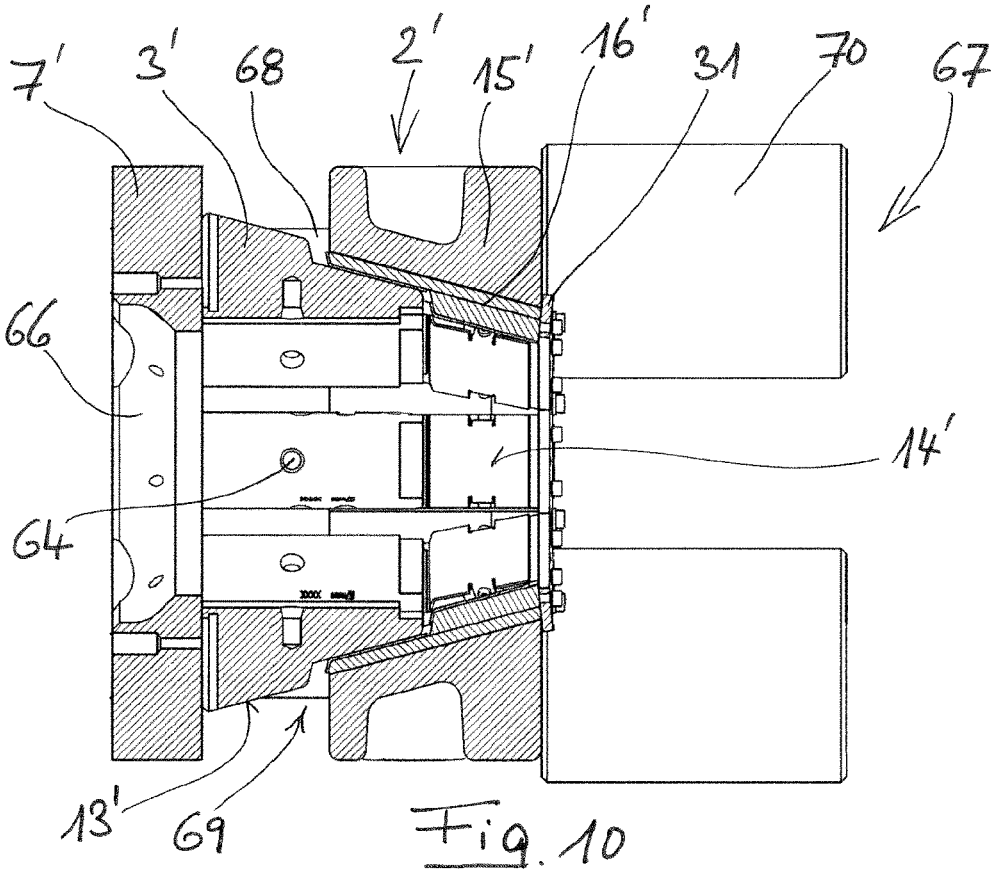
FIG. 10 shows an implementation corresponding to a further preferred exemplary embodiment on the pressure-plate radial press illustrated in FIG. 9 in open operating position.
Figure 11:
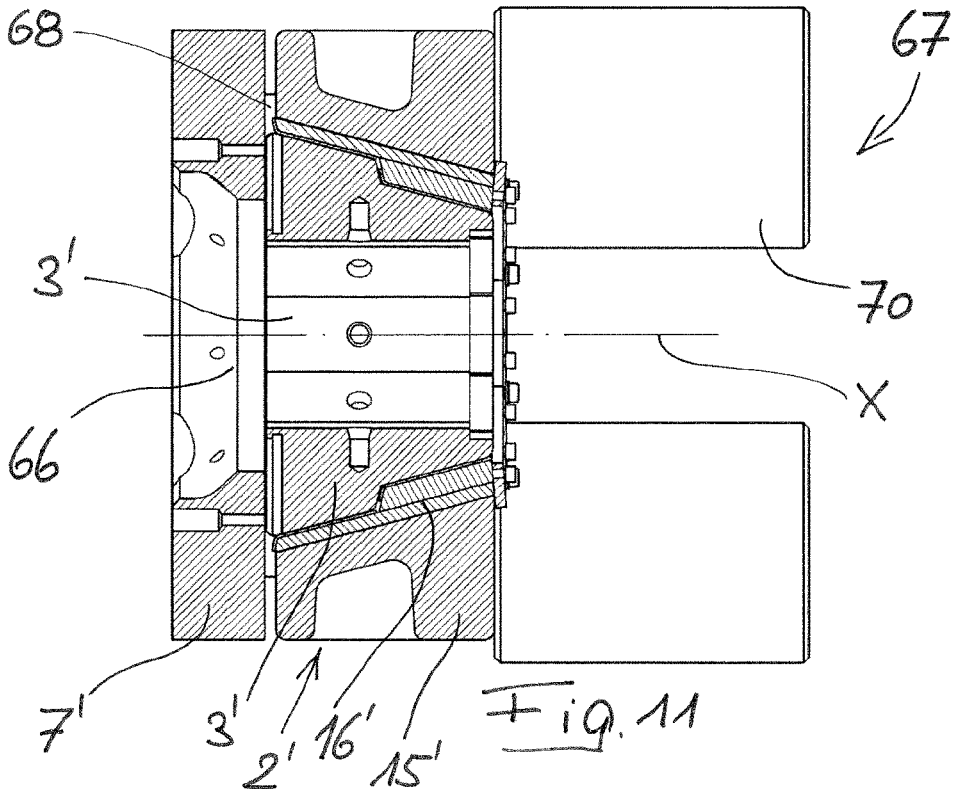

The embodiment illustrated in FIGS. 7 and 8 is likewise largely explained from the foregoing explanations of FIGS. 1 to 6, to which reference is made in order to avoid repetitions. A substantial feature distinguishing this embodiment from those described in the foregoing consists in the eight cutouts 56—disposed in alignment with press jaws 3—provided on housing 1 at the transition from jacket portion 6 to bracing disk 7. These assume the function of dirt outlet opening 47 according to the exemplary embodiments explained in the foregoing and in other respects are dimensioned such that guide elements 11 can be inserted through cutouts 56 into housing 1. Guide elements 11 are angled and are respectively provided with a fixation bracket 58 bearing radially outside on a bracing face 57. Guide elements 11 are bolted there to housing 1 from radially outside in the region of cutouts 56. In this way, threaded bores machined into bracing disk 7 from the end face thereof are unnecessary, which is favorable to the flow of force in this highly stressed part. Return-stroke working chamber 42 is also configured somewhat differently from the embodiments described in the foregoing. In particular, sealing takes place here not in the region of a sealing shoulder integral with the housing but instead in the region of a seal 59, which is inserted into an annular groove 60 of base structure 15 of annular structure 2 and is guided sealingly in a cylinder portion 61, which is constructed in jacket portion 6 and has a slightly smaller diameter than cylinder portion 38 bounding the press working chamber.

And, finally, separate control members, which with control face 14 constructed respectively thereon (on a sliding plate 19) can again be inserted exchangeably into base structure 15 of annular structure 2, as in the exemplary embodiment according to FIGS. 1 to 4. However, the control members are only two-piece components here, with a stepped sliding-plate carrier 63, which unites the functions of bed plate 17 and hump 18 of the exemplary embodiment according to FIGS. 1 to 4 in itself and is geometrically configured accordingly. The through-going exchangeable sliding plates 19, respectively of one-piece construction, are respectively bolted axially (at the end face) to the sliding-plate carrier 63 in question. The explanations of FIGS. 1 to 4 apply correspondingly for the geometry of control faces 14 and of sliding faces 13.

In all exemplary embodiments, it is obvious that press jaws 3 are constructed—in conventional manner—so as to receive press-jaw heads exchangeably. For this purpose, they are provided with receiving bores 64 for retaining pegs and associated interlocks 65 disposed on the press-jaw heads.

In the realization of the present disclosure illustrated in FIGS. 9-12 on a radial press constructed in pressure-plate design, this possesses a bracing plate 7' of approximately square format extending annularly at the end face around a cutout 66 and an annular structure 2' guided displaceably relative to bracing plate 7' along press axis X. The function of bracing plate 7' corresponds in the scope relevant here to the function of bracing disk 7 according to the exemplary embodiments of FIGS. 1 to 8. Specifically, the eight press jaws 3' are braced in radially displaceable manner on it. And the function of annular structure 2' corresponds in the scope relevant here to the function of annular structure 2 according to the exemplary embodiments of FIGS. 1 to 8. In implementation of the present disclosure, annular structure 2' comprises a base structure 15' and eight exchangeable control members 16' received therein—respectively between two guide ribs (not shown) for press jaws 3'—with control faces 14' constructed thereon. Control members 16' are fixed by means of locking ring 31 on base structure 15'. The construction of these control members (see FIG. 12) is based on that of the control members 16 shown in FIG. 4, and so reference is made to the corresponding explanations. A corresponding situation applies for the incorporation of control members 16' into the rest of annular structure 2'. In particular, control faces 14' in planes perpendicular to press axis X also lie respectively here—due to the geometry of the control members—on a polygon with corners disposed respectively between two press jaws 3' adjacent to one another.

Between bracing plate 7' and annular structure 2', a drive unit 67 comprising several (e.g. four) cylinder-piston structures acts—in a way known in itself—to bring about their movement relative to one another. Cylinders 70 of the cylinder-piston structures are firmly joined to base structure 15' of annular structure 2'. Piston rods 68 connected to the pistons are constructed as pulling rods 69 and are joined at their end to bracing plate 7'.

From the foregoing explanations, it is easily apparent for a person skilled in the art that, instead of the radial guidance of press jaws 3' on bracing plate 7'—as realized in the exemplary embodiment according to FIGS. 9-12—a guide, inclined relative to press axis X and having a radial movement component as well as an additional axial movement component, may also be considered. In a special configuration that is conceivable in this respect, the slidingly guided bracing of press jaws 3' on bracing plate 7' may be constructed as a mirror image of the slidingly guided bracing of press jaws 3' on annular structure 2'.

What is claimed is:

1. A radial press having:

a housing (1) provided with a jacket portion (6) and an annular bracing disk (7) at an end face of the housing, an annular structure (2) guided displaceably within the housing along a press axis (X) and a plurality of press jaws (3), wherein the plurality of press jaws are disposed around the press axis (X), and are braced in a radially displaceably guided manner on the bracing disk (7), and wherein the annular structure (2) acts on the plurality of press jaws by means of control faces (14), wherein the control faces are inclined relative to the press axis (X) and bear on mating faces of the press jaws (3), the mating faces constructed as sliding faces (13), wherein an angle of inclination of the control faces (14) is changed along an axial direction in such a way that axial movement of the annular structure and resulting radial movement of the press jaws (3) are in different ratios relative to one another over the maximum movement path of the annular structure (2), wherein:

the annular structure (2) has a base structure (15) and, received within the base structure, exchangeable control members (16) with the control faces (14) constructed on a surface of exchangeable sliding plates (19), the exchangeable sliding plates being components of the respective exchangeable control member, wherein the changing angle of inclination of the control faces is defined by a geometry of a corresponding exchangeable control member, wherein, in planes perpendicular to the press axis (X), the control faces (14) each form a polygon with corners disposed respectively between two press jaws (3) of the plurality of press jaws adjacent to one another.

2. The radial press of claim 1, wherein the exchangeable control members (16) bear respectively along a plane bracing face (26) on the base structure (15).

3. The radial press of claim 2, wherein the plane bracing faces (26) converge in the axial direction.

4. The radial press of claim 2, wherein the plane bracing faces (26) extend parallel to the press axis (X).

5. The radial press of claim 1, wherein the exchangeable control members (16) each bear respectively on a convex bracing face (26) of the base structure (15).

6. The radial press of claim 1 further comprising press-jaw guide ribs, wherein the press-jaw guide ribs (36) are constructed between two of the exchangeable control members (16) and are respectively provided on the base structure (15).

7. The radial press of claim 1, wherein the exchangeable control members (16) are provided with lateral press-jaw guide ribs (36).

8. The radial press of claim 1, wherein the exchangeable control members (16) respectively have a bed plate (17) bearing on the base structure (15) and a hump (18) placed on a portion of the bed plate.

9. The radial press of claim 1, wherein the angle of inclination of the control faces (14) changes continuously over a portion of their extent.

10. The radial press of claim 1, wherein the control faces (14) are provided with at least two separate plane regions (32; 33).

11. The radial press of claim 10, wherein wherein the at least two separate plane regions (32; 33) are offset parallel to one another in pairs.

12. The radial press of claim 10, wherein the at least two separate plane regions (32, 33) are adjacent to one another and merge edgelessly into one another.

13. The radial press of claim 1, wherein at least during individual operating positions of the annular structure (2), the control faces (14) thereof and the sliding faces (13) of the press jaws (3) bear on one another along a length of the corresponding control face or sliding surface.

14. The radial press of claim 1, wherein the press jaws (3) are provided with exchangeable sliding plates (55), and the sliding faces (13) are constructed on the respective exchangeable sliding plates.

15. The radial press of claim 1, wherein the annular structure (2) comprises an annular piston (37), wherein the annular piston is guided sealingly in a press-cylinder portion (38) constructed in the jacket portion (6) of the housing (1) and wherein the annular piston and the press-cylinder portion bound an annular press working chamber (40).

16. The radial press of claim 15, wherein an annular return-stroke working chamber (42) is bounded by a cylinder face (45) disposed on an outer circumference of the annular structure (2) and is guided in a sealing shoulder (44) integral with the housing, and wherein the return-stroke working chamber is disposed between the press working chamber (40) and the bracing disk (7).

17. The radial press of claim 16, wherein the return-stroke working chamber (42) is bounded by the press-cylinder portion (38) and an annular zone (43) constructed on the annular piston (37), the annular zone being on an end face of the annular piston facing away from the press working chamber (40).

18. The radial press of claim 16, wherein the jacket portion (6) of the housing (1) is provided between the sealing shoulder (44) and the bracing disk (7) with a dirt outlet opening (47).

19. The radial press of claim 15, wherein the press working chamber (40) is bounded by a housing closure ring (8) disposed opposite the bracing disk (7) and a cylindrical extension (39) of the annular structure (2) guided sealingly within the housing closure ring.

20. The radial press of claim 1, wherein the bracing disk (7) and the jacket portion (6) are part of a one-piece housing basic structure (5).

21. The radial press of claim 1, wherein the annular structure (2) is surrounded at an end region closest to the bracing disk (7) by a nonmetallic fiber reinforcing ring (53).

22. The radial press of claim 1, wherein exchangeable guide elements (11) cooperating with the press jaws (3) are attached to the bracing disk (7).

23. The radial press of claim 1, wherein exchangeable guild elements cooperating with the press jaws are attached to the bracing disk, and the guide elements (11) can be inserted through the cutouts (56) into the housing (1).

24. The radial press of claim 23, wherein the guide elements (11) are angled and are respectively provided with a fixation bracket (58) bearing radially on the outside of a bracing face (57).

25. The radial press of claim 24, wherein the guide elements (11) are bolted to the housing (1) from radially outside in the region of the cutouts (56).

26. A radial press having:

a bracing plate (7') extending annularly at the end face around a cutout (66), an annular structure (2') guided displaceably relative to the bracing plate along a press axis (X), a drive unit (67) acting between the bracing plate (7') and the annular structure (2'), and a plurality of press jaws (3'), which are disposed around the press axis (X) and are braced, in a displaceably guided manner with radial directional components, on the bracing plate (7'), and the annular structure (2') acts on the plurality of press jaws by means of control faces (14'), wherein the control faces are inclined relative to the press axis (X) and bear on mating faces of the press jaws (3'), the mating faces constructed as sliding faces (13'), wherein an angle of inclination of the control faces (14') is changed along an axial direction in such a way that axial movement of the annular structure and resulting radial movement of the press jaws (3') are in different ratios relative to one another over the maximum movement path of the annular structure (2') and of the bracing plate relative to one another, wherein the annular structure (2') has a base structure (15') and, received within the base structure exchangeable control members (16') with the control faces (14') constructed on a surface of exchangeable sliding plates (19), the exchangeable sliding plates being components of the respective exchangeable control members, wherein the changing angle of inclination of the control faces is defined by a geometry of a corresponding exchangeable control member, wherein, in planes perpendicular to the press axis (X), the control faces (14') each form a polygon with corners disposed respectively between two press jaws (3') of the plurality of press jaws adjacent to one another.

27. The radial press of claim 26, wherein the plurality of press jaws (3') are guided in a radially displaceable manner on the bracing plate (7').

28. A radial press having:

a housing (1) provided with a jacket portion (6) and an annular bracing disk (7) at an end face of the housing, an annular structure (2) guided displaceably within the housing along a press axis (X) and a plurality of press jaws (3), wherein the plurality of press jaws are disposed around the press axis (X), and are braced in a radially displaceably guided manner on the bracing disk (7), and wherein the annular structure (2) acts on the plurality of press jaws by means of control faces (14), wherein the control faces are inclined relative to the press axis (X) and bear on mating faces of the press jaws (3), the mating faces constructed as sliding faces (13), wherein an angle of inclination of the control faces (14) is changed along an axial direction in such a way that axial movement of the annular structure and resulting radial movement of the press jaws (3) are in different ratios relative to one another over the maximum movement path of the annular structure (2), wherein:

the annular structure (2) has a base structure (15) and, received within the base structure, exchangeable control members (16) with the control faces (14) constructed on the respective exchangeable control members, wherein the changing angle of inclination of the control faces is defined by a geometry of a corresponding exchangeable control member, wherein, in planes perpendicular to the press axis (X), the control faces (14) each form a polygon with corners disposed respectively between two press jaws (3) of the plurality of press jaws adjacent to one another; and wherein the housing (1) is provided at a transition from the jacket portion (6) to the bracing disk (7) with a number of cutouts (56) corresponding to the number of the plurality of press jaws (3).

* * * * *